US006445279B1

(12) United States Patent
Lin et al.

(10) Patent No.: US 6,445,279 B1
(45) Date of Patent: Sep. 3, 2002

(54) VARIABLE RESISTANCE DEVICE

(75) Inventors: Chao-Jung Lin, Taoyuan; Chien-Ming Li, Taipei Hsien, both of (TW)

(73) Assignee: Darfon Electronics Corp., Taoyuan (TW)

( * ) Notice: Subject to any disclaimer, the term of this patent is extended or adjusted under 35 U.S.C. 154(b) by 3 days.

(21) Appl. No.: 09/884,539

(22) Filed: Jun. 19, 2001

(30) Foreign Application Priority Data

Jun. 29, 2000 (TW) ..... 089211142

(51) Int. Cl.[7] ..... H01C 10/32

(52) U.S. Cl. ..... 338/168; 338/174; 338/170; 338/162

(58) Field of Search ..... 338/162, 167, 338/168, 170, 163, 174, 157

(56) References Cited

U.S. PATENT DOCUMENTS 3,119,089 A * 1/1964 Murry ..... 338/162
3,533,043 A * 10/1970 Spaude ..... 338/162
3,629,780 A * 12/1971 Burcham et al. ..... 338/198
4,821,014 A * 4/1989 Masuda et al. ..... 338/164
5,726,625 A * 3/1998 Hasebe et al. ..... 338/162

* cited by examiner

*Primary Examiner*—Karl D. Easthom
(74) *Attorney, Agent, or Firm*—Ladas & Parry

(57) ABSTRACT

A variable resistance device is provided. Instead of a conventional planar-type structure or a three-dimensional structure using an elastic strip, a variable resistance device with a three-dimensional structure using easy-assembling parts, such as a mount and a spring, is adapted. The easy-assembling parts would not be deformed permanently so that the reliability of the variable resistance device is enhanced.

20 Claims, 9 Drawing Sheets

VARIABLE RESISTANCE DEVICE

BACKGROUND OF THE INVENTION

1. Field of the Invention

The invention relates to a variable resistance device; in particular, the invention relates to a variable resistance device that makes the assembling easier and enhances its quality.

2. Description of the Related Art

Variable resistance devices find many uses in electrical equipment. One common use of variable resistance devices is used to control voltage in, for example, flyback transformers.

When used in a flyback transformer, a variable resistance device must meet a number of requirements. The foremost requirement is size. This poses a problem for variable resistance devices that typically rely on electromechanical structures to provide variable resistance.

Known variable resistance devices also are typically constructed of a relatively large number of small parts, increasing the difficulty of assembly and, correspondingly, the cost of the devices. In addition, the reliability is impaired because of the likelihood that each of the many parts presents an opportunity for failure in the device.

One example of a known variable resistance device is shown in FIG. 1. Such variable resistance device 10 is consisted of a substrate 11 and a rotor 12. A resistive region 111 is formed on the substrate 11. The resistive region 111 is consisted of a central part 1111 and a semi-circular path 1112. A distance X1 is maintained as a safe gap between the central part 1111 and the semi-circular path 1112. The central part 1111 is electrically connected to an external circuit (not shown). A spring 121 is disposed at the bottom of the rotor 12. The spring 121 has a first end 1211 and a second end 1212.

The first end 1211 of the spring 121 is in contact with the central part 1111 of the resistive region 111. The second end 1212 of the spring 121 is in contact with the semi-circular path 1112 of the resistive region 111. The second end 1212 is movable along the semi-circular path 1112.

Therefore, users can move the second end 1212 along the semi-circular path 1112 by rotating the rotor 12 to change the resistance.

The disadvantage of the variable resistance device 10 is that its size has a minimum limit. Specifically, since two ends of the spring 121 are on the same plane, in view of the safe gap X1, the size of the substrate 11 has a minimum limit.

The other example of a known variable resistance device is shown in FIG. 2. Such variable resistance device 20 is also consisted of a substrate 21 and a rotor 22. A resistive region 211 is formed on the substrate 21. The resistive region 211 comprises a semi-circular path. A point C1 is used as a center of the semi-circular path. A distance Y2 is maintained as a safe gap between the point C1 and the semi-circular path. The rotor 22 is provided with a rod 221 and an elastic strip 222 at its bottom. The elastic strip 222 has a first end 2221 and a second end 2222. The rod 221 abuts the point C1 of the substrate 21. The first end 2221 is movable along the resistive region 211, and the second end 2222 is electrically connected to an external circuit (not shown). Therefore, users can move the first end 2221 along the semi-circular path by rotating the rotor 22 to change the resistance.

As shown in FIG. 2, the first end 2221 of the variable resistance device 20 extends outwardly from the bottom of the rotor 22 in an inclined angle. Hence, comparing with the safe gap X1 as shown in FIG. 1, the safe gap Y2 can be reduced. As a result, the size of the substrate 21 can be decreased.

However, the disadvantages of the variable resistance device 20 are that its elastic strip 222 is easily deformed, it is hard to assemble, and it cannot be assembled repeatedly.

SUMMARY OF THE INVENTION

In view of the disadvantages of the aforementioned conventional variable resistance device, the invention provides a variable resistance device that can make the assembly easier and enhances its quality.

Accordingly, the variable resistance device of the invention comprises a substrate and a rotor. A resistive region is formed on the substrate. The rotor is disposed on the substrate, after which it is rotatable. The rotor comprises a first contact member, a mount, a rotating member and a second contact member. The first contact member has a first end and a second end, wherein the first end abuts the resistive region in an elastic manner. The mount is used for receiving the first contact member. The rotating member engages the mount. The second contact member, disposed between the mount and the rotating member, abuts the second end of the first contact member in a movable manner.

Furthermore, the mount has a first through hole and a receiving portion; therefore, the rotating member passes through the first through hole to engage the mount, and the receiving portion is used for receiving the first contact member.

Furthermore, the receiving portion is a second through hole.

Furthermore, the first contact member comprises a rivet, a spring and a ball. The rivet abuts the resistive region. The spring, surrounding the rivet, is disposed inside the second through hole and abutting the rivet in one end. The ball abuts the second contact member and the other end of the spring.

Furthermore, the first contact member comprises a spring, a first ball and a second ball. The spring is disposed inside the second through hole. The first ball is disposed between the second contact member and one end of the spring. The second ball is disposed between the substrate and the other end of the spring.

Furthermore, the first contact member comprises a rivet and a spring. The rivet abuts the resistive region in one end. The spring, surrounding the rivet, is disposed inside the second through hole.

Furthermore, the second contact member has a hollow portion for the rotating member passing through.

Furthermore, the variable resistance device further comprises a housing. The housing has a first portion for combining with the substrate and a second portion for combining with the rotor.

Furthermore, a variable resistance device of the invention comprises a substrate and a rotor. A resistive region is formed on the substrate. The rotor is rotatablly disposed on the substrate and comprises a first contact member, a mount, a rotating member, a second contact member and a cushion member. The first contact member has a first end and a second end. The first end abuts the resistive region. The mount is used for receiving the first contact member. The rotating member engages the mount. The second contact member, disposed between the mount and the rotating member, abuts the second end of the first contact member in a movable manner. The cushion member, disposed between the second contact member and the rotating member, is used for cushioning the contact between the first contact member and the resistive region.

Furthermore, a variable resistance device of the invention comprises a substrate and a rotor. A resistive region is formed on the substrate. The rotor is disposed on the substrate, after which it can rotate, and comprises a first contact member, a mount, a rotating member and a conducting interface. The first contact member has a first end and a second end. The first end abuts the resistive region. The mount is used for receiving the first contact member. The rotating member engages the mount, and the rotating member abuts the mount. The conducting interface is formed on a surface, abuts the mount, of the rotating member. The conducting interface abuts the second end of the first contact member in a movable manner.

BRIEF DESCRIPTION OF THE DRAWINGS

The invention is hereinafter described in detail by reference to the accompanying drawings in which.

DETAILED DESCRIPTION OF THE INVENTION

First Embodiment

Figure 1:
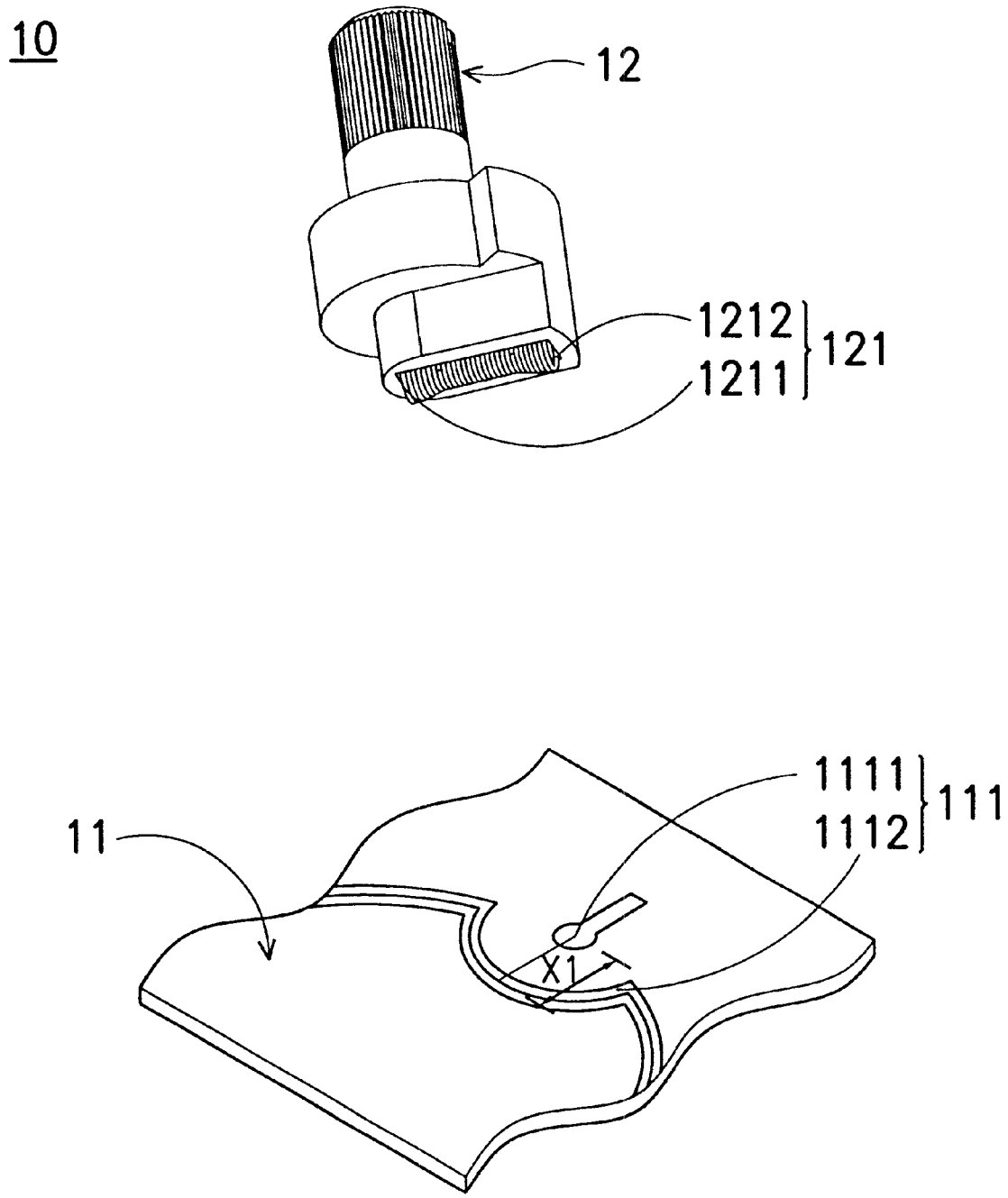
FIG. 1 ( PRIOR ART )
FIG. 1 is a schematic view depicting a conventional variable resistance device.
Figure 2:
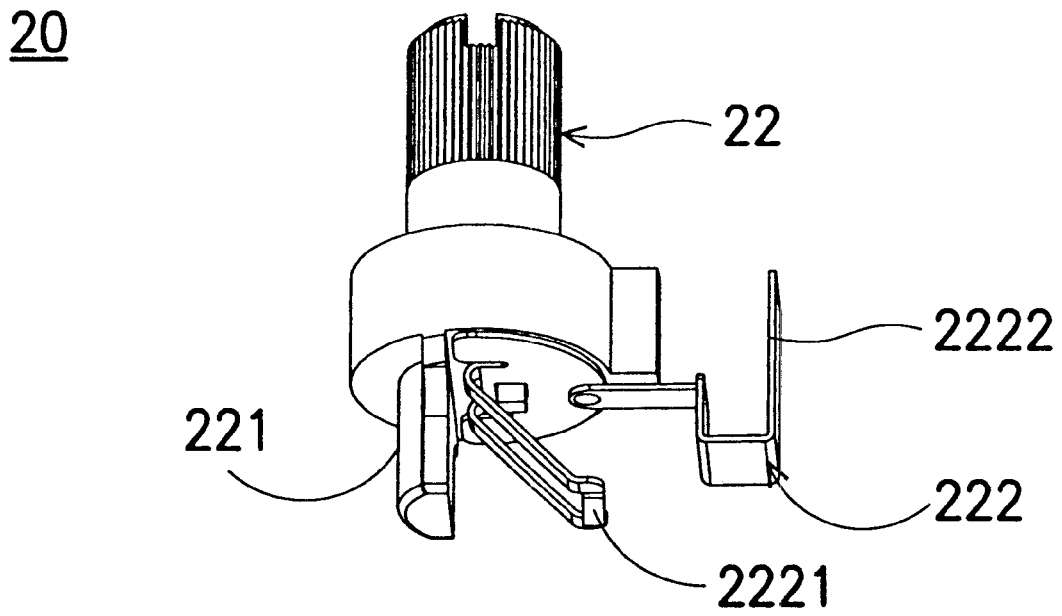
FIG. 2 ( PRIOR ART )
FIG. 2 is a schematic view depicting the other conventional variable resistance device.
Figure 2:
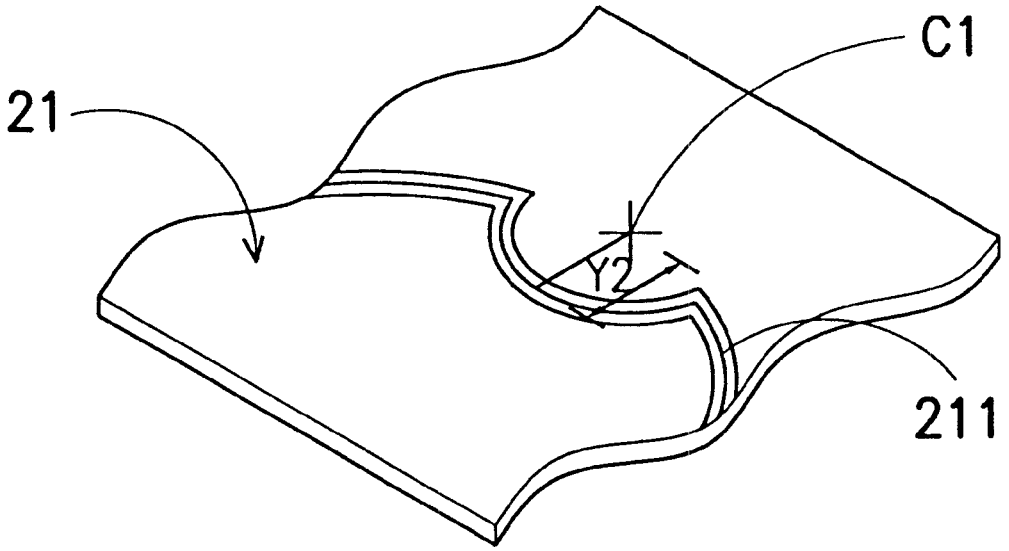
FIG. 2 ( PRIOR ART )

As shown in FIGS. 3*a*, 3*b*, 4*a* and 4*b*, a variable resistance device 30 of a first embodiment of the invention comprises a substrate 31 and a rotor 32. A resistive region 311 is formed on a surface, facing the rotor 32, of the substrate 31.

The rotor 32 is disposed on the substrate 31, after which it is rotatable. The rotor 32 comprises a rotating member 321, a second contact member 322, a mount 323 and a first contact member 324.

The first contact member 324 abuts the resistive region 311 in an elastic manner. In this embodiment, the first contact member 324 comprises a spring 3241 and a rivet 3242. The spring 3241 provides the first contact member 324 with an elastic force. One end of the rivet 3242, hereinafter also called a first end of the first contact member 324, abuts the resistive region 311. In view of protecting the substrate's life, it is preferable that the first end be ball-shaped.

The mount 323 is provided with a first through hole 3231 and a receiving portion 3232, hereinafter also called a second through hole. The first through hole 3231 is used for the rotating member 321 passing through. The second through hole 3232 is used for receiving the first contact member 324. The spring 3241, surrounding the rivet 3242, is disposed inside the second through hole 3232.

The rotating member 321 is provided with a rod 3211 that passes through the first through hole 3231 and engages with the mount 323. By the engagement between the rod 3211 and the first through hole 3231, the rotating member 321 can rotate the mount 323. The rod 3211 abuts the substrate 31. The second contact member 321, disposed between the rotating member 321 and the mount 323, is independent from the rotation of the rotating member 321 and the mount 323. The other end of the rivet 3242, hereinafter also called a second end of the first contact member 324, abuts the second contact member 322. The second contact member 322 is provided with a hollow portion 3221 and a protrusion 3222. The hollow portion 3221 is used for the rod 3211 passing through. The protrusion 3222 is electrically connected to an external circuit (not shown).

In addition, the variable resistance device 30 comprises a housing 33. The housing 33 has a first portion 331 for combining with the substrate 31 and a second portion 332 for combining with the rotor 32.

Figure 3A:
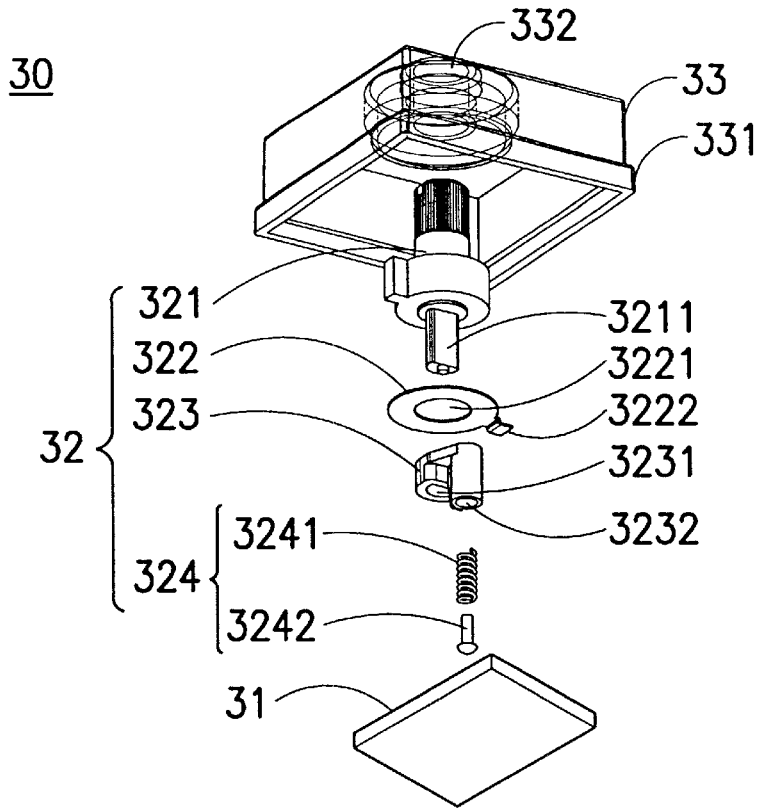
FIG. 3*a* is a deposition diagram depicting a first embodiment of a variable resistance device of the invention.
Figure 3B:
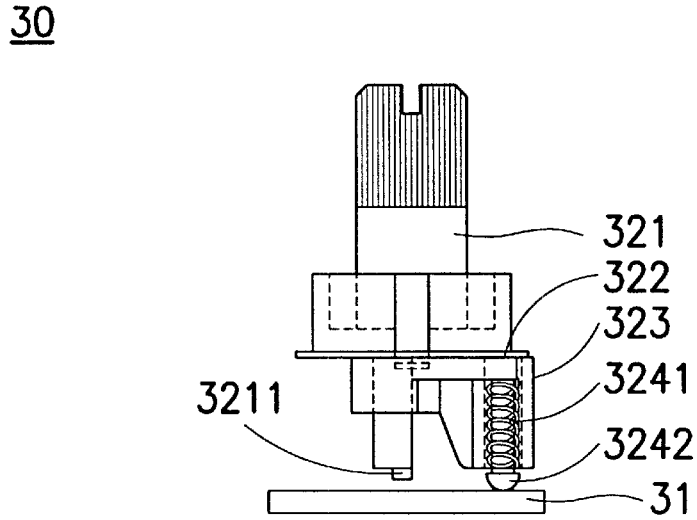
FIG. 3*b* is a side view depicting the first embodiment of the variable resistance device of the invention, wherein the assembling of the variable resistance device is completed.
Figure 4A:
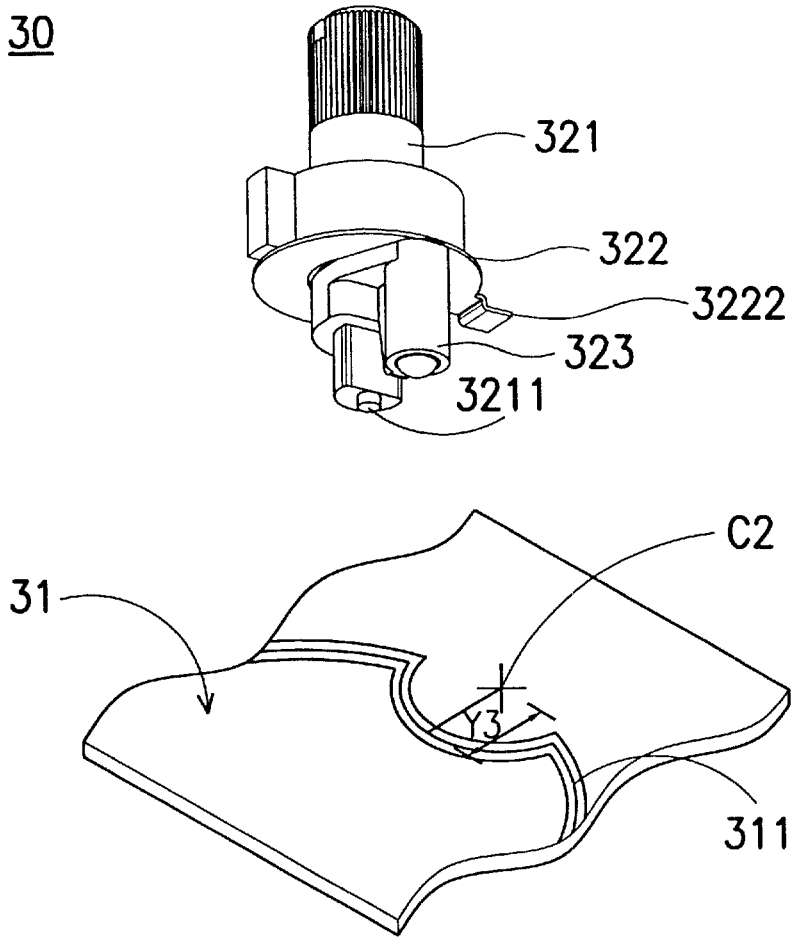
FIG. 4*a* is a schematic view depicting the first embodiment of the variable resistance device of the invention.

It is noted that the housing 33 is omitted in FIG. 3*b* and FIG. 4*a*. After the assembling of the variable resistance device 30 is completed, as shown in FIG. 3*b*, users can move the rivet 3242 along the resistive region 311 by rotating the rotating member 321. As a result, users can attain a desired value of the resistance.

Figure 4B:
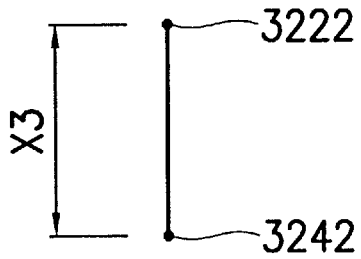
FIG. 4*b* is a diagram showing a distance between a protrusion and a rivet of the first embodiment of the variable resistance device of the invention.

FIG. 4*b* shows a distance X3 between the protrusion 3222 and a contact point that is between the rivet 3242 and the resistive region 311. Since the distance X3 is perpendicular, a distance Y3 between a semi-circular path and its center C2 can be reduced. Hence, the size of the substrate 31 is decreased correspondingly.

Furthermore, the first contact member of this embodiment is consisted of durable parts, such as the spring and the rivet; therefore, the assembly is easier. In addition, the assembling flexibility of this variable resistance device is enhanced. As a result, the yield of the variable resistance device is increased.

Second Embodiment

Figure 5:
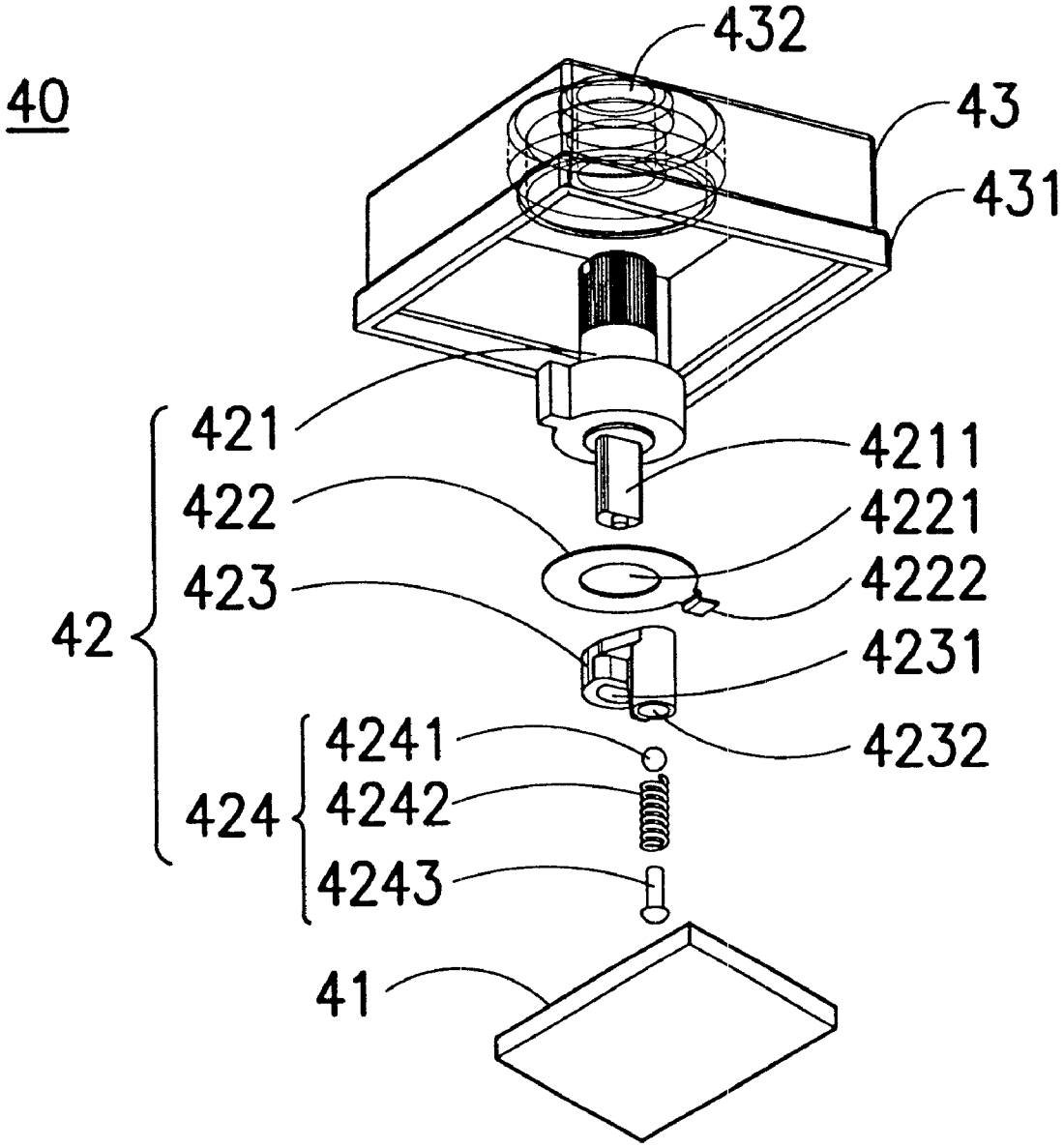
FIG. 5 is a deposition diagram depicting a second embodiment of a variable resistance device of the invention.

A second embodiment of a variable device 40 of the invention is shown in FIG. 5. Some parts of the variable resistance device 40 are the same as the first embodiment; therefore, their descriptions are omitted.

The difference between this embodiment and the first embodiment is that in the second embodiment, the first contact member 424 comprises a ball 4241, a spring 4242 and a rivet 4243. The ball 4241 is additionally disposed between the spring 4242 and the second contact member 422. Since the ball 4241 is disposed on the end, facing the second contact member 422, of the spring 4242, the movement of the first contact member 424 on the second contact member 422 becomes smoother.

Third Embodiment

Figure 6:
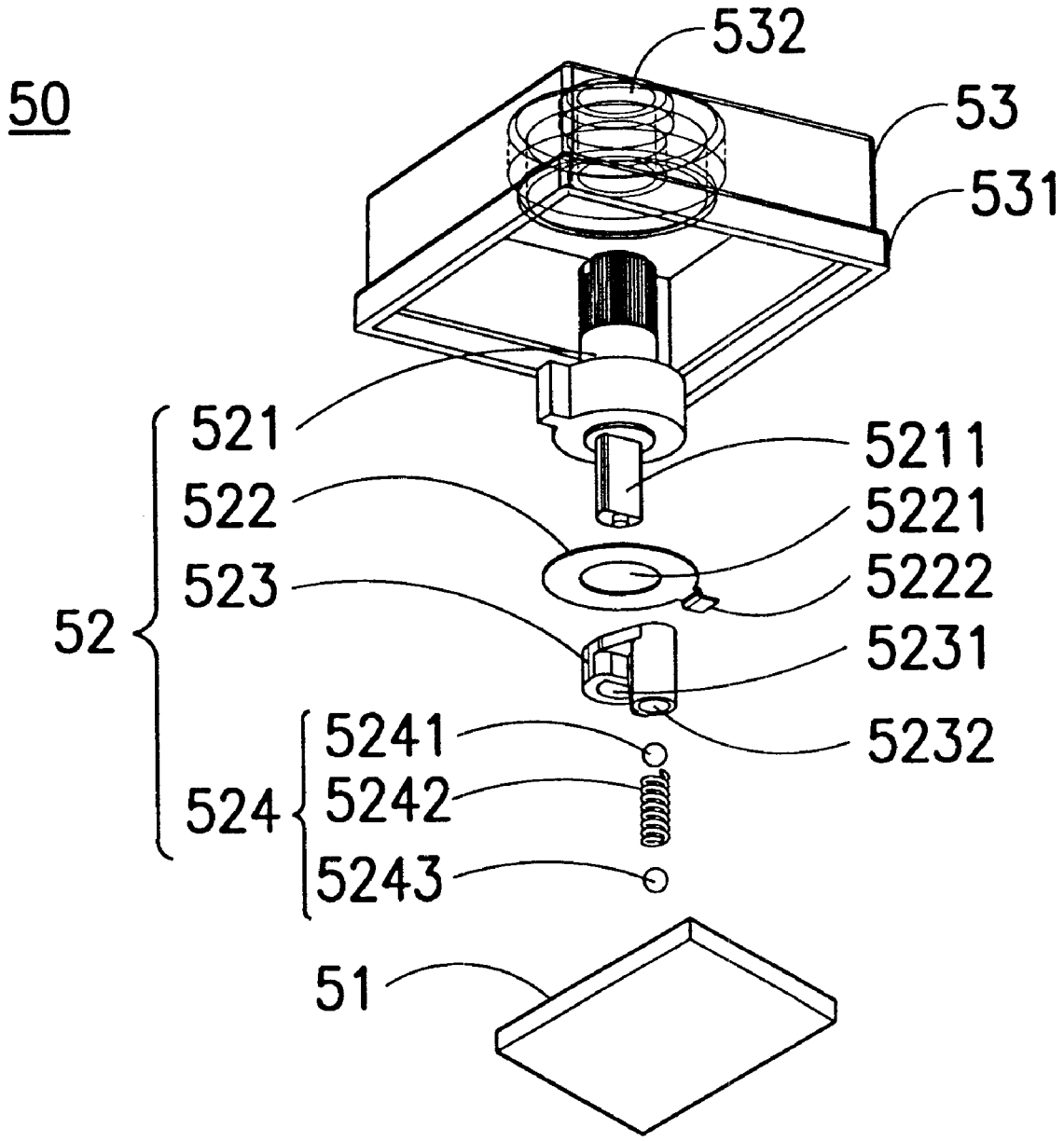
FIG. 6 is a deposition diagram depicting a third embodiment of a variable resistance device of the invention.

A third embodiment of a variable device 50 of the invention is shown in FIG. 6. Some parts of the variable resistance device 50 are the same as the second embodiment; therefore, their descriptions are omitted.

The difference between this embodiment and the second embodiment is that in the third embodiment, the first contact member 524 comprises a first ball 5241, a spring 5242 and a second ball 5243. The second ball 5243 is additionally disposed between the spring 5242 and the substrate 51 to replace the rivet in the second embodiment. Since the second ball 5243 is disposed on the end, facing the substrate 51, of the spring 5242, the movement of the first contact member 524 on the substrate 51 becomes smoother.

Fourth Embodiment

Figure 7:
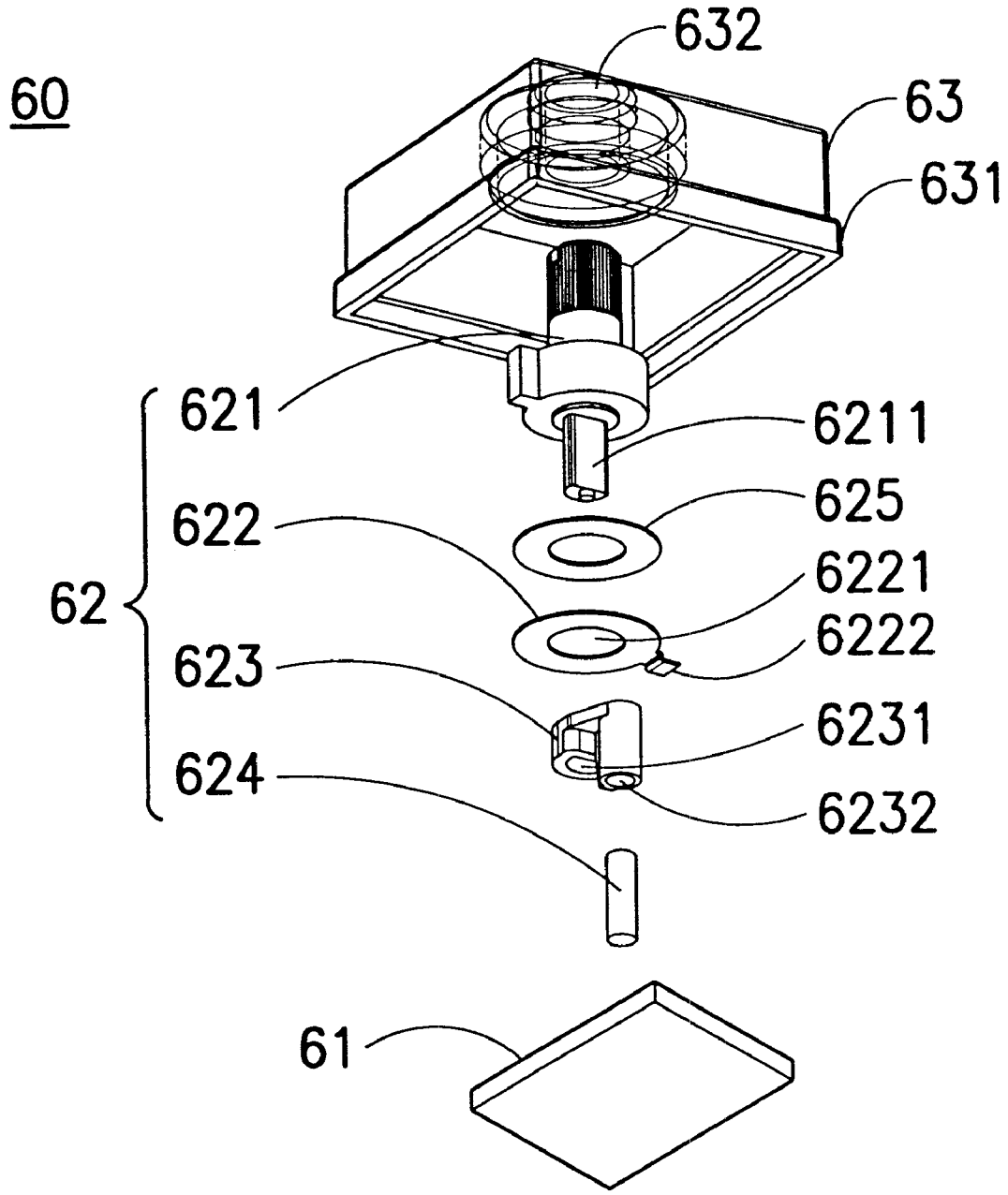
FIG. 7 is a deposition diagram depicting a fourth embodiment of a variable resistance device of the invention.

A fourth embodiment of a variable device 60 of the invention is shown in FIG. 7. Some parts of the variable resistance device 60 are the same as the first embodiment; therefore, their descriptions are omitted.

The difference between this embodiment and the first embodiment is that in the fourth embodiment, the cushion member 625 is additionally disposed between the second contact member 622 and the rotating member 621. Apparently, the cushion member 625 has a cushion function, and it is used to replace the spring of the above embodiments. Therefore, the first contact member 624 can be made by a stick.

Fifth Embodiment

Figure 8A:
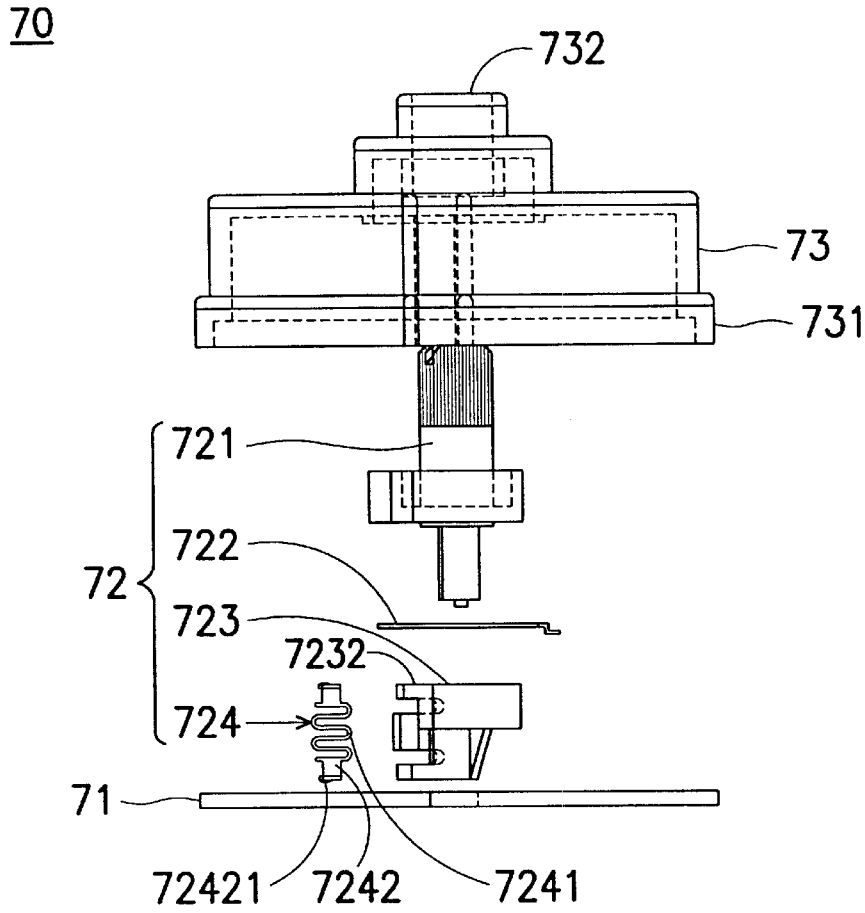
FIG. 8*a* is a deposition diagram depicting a fifth embodiment of a variable resistance device of the invention.
Figure 8B:
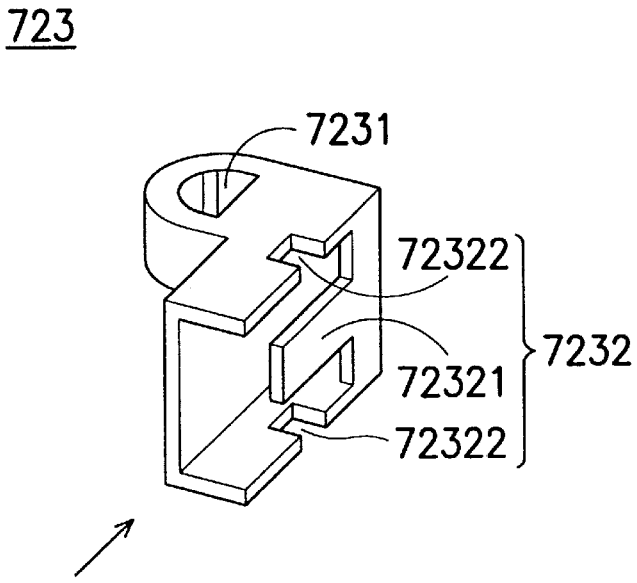
FIG. 8*b* is a schematic diagram depicting the other mount of the invention.

A fifth embodiment of a variable device 70 of the invention is shown in FIG. 8*a* and FIG. 8*b*. Some parts of the variable resistance device 70 are the same as the first embodiment; therefore, their descriptions are omitted.

The difference between this embodiment and the first embodiment is that in the fifth embodiment, the first contact member 724 comprises a spring portion 7241 and two contact portions 7242, integrally formed at both ends of the spring portion 7241. Ball-shaped dots 72421 are formed on the surface of the contact portions respectively; therefore, the contact between the second contact member 722 and the substrate 71 becomes smooth.

Also, the receiving portion 7232 can be formed as shown in FIG. 8*b* to fit with the shape of the first contact member 724. The first contact member 724 is putted into the mount 723 in an arrow direction of FIG. 8*b*. After the first contact member 724 is disposed inside the mount 723, the spring portion 7241 is blocked by a plate 72321 and the contact portions 7242 are located inside cuts 72322 respectively.

Sixth Embodiment

Figure 9:
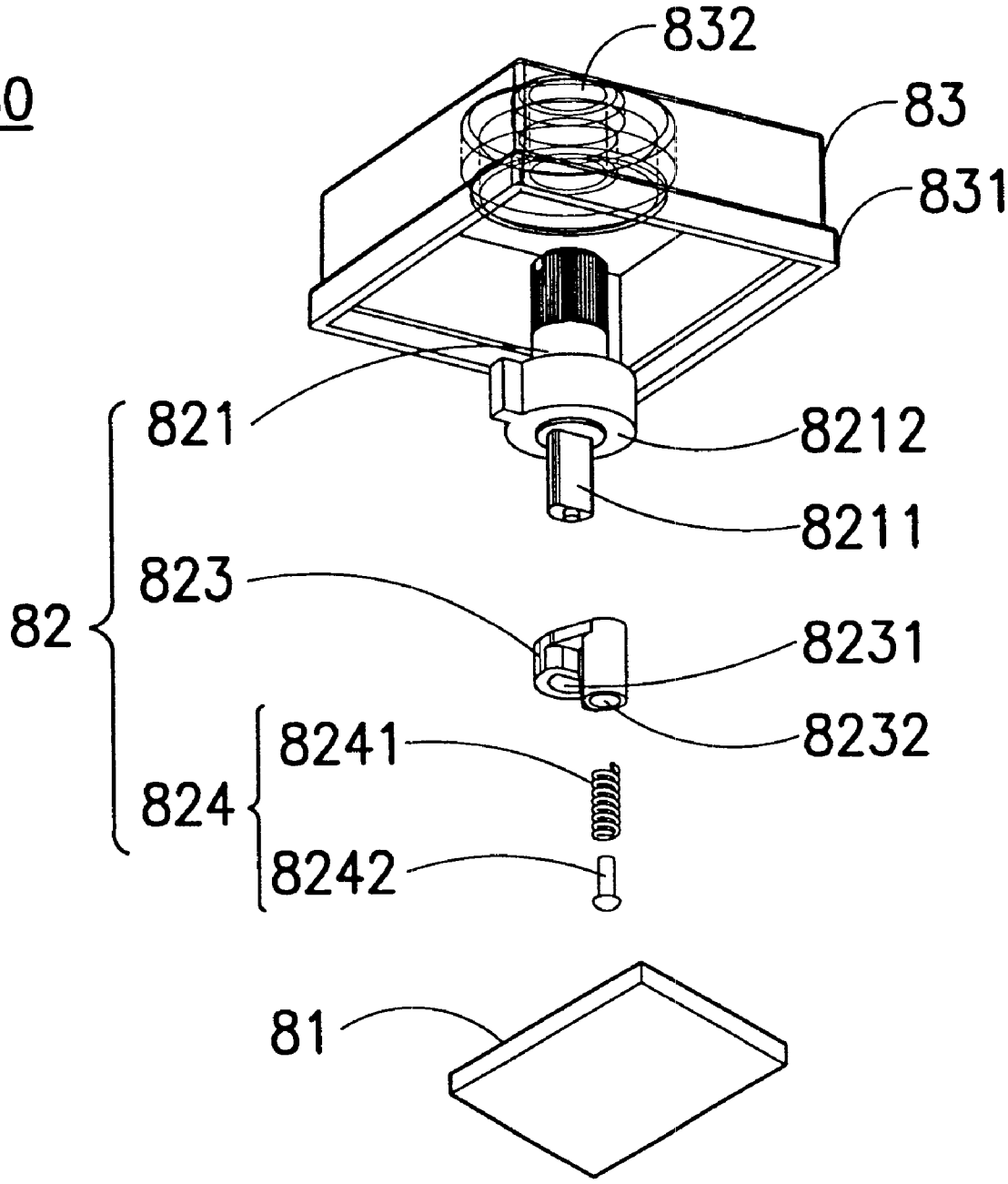
FIG. 9 is a deposition diagram depicting a sixth embodiment of a variable resistance device of the invention.

A sixth embodiment of a variable device 80 of the invention is shown in FIG. 9. Some parts of the variable resistance device 80 are the same as the first embodiment; therefore, their descriptions are omitted.

The difference between this embodiment and the first embodiment is that in the sixth embodiment, a conducting interface 8212 is formed on a surface, abutting the mount 823, of the rotating member 821; therefore, the second contact member of the first embodiment is omitted. The rotating member 821 directly engages with the mount 823. One end of the first contact member 824 abuts the conducting interface 8212 in a movable manner.

Electric-conductive material of the conducting interface 8212 is formed on the rotating member 821 by the electroplating. As a result, since the second contact member is omitted, the assembling of the variable resistance device 80 becomes easier.

As stated above, since the variable resistance device of this invention is a three-dimensional structure, its yield can be increased. In addition, since the parts of this variable resistance device can not be deformed easily, its reliability is enhanced.

While the invention has been particularly shown and described with reference to a preferred embodiment, it will be readily appreciated by those of ordinary skill in the art that various changes and modifications may be made without departing from the spirit and scope of the invention. It is intended that the claims be interpreted to cover the disclosed embodiment, those alternatives which have been discussed above, and all equivalents thereto.

What is claimed is:

1. A variable resistance device, comprising:

a substrate with a resistive region forming thereupon; and a rotor rotatably disposed on the substrate, the rotor having:

a first contact member having a first end and a second end, wherein the first end abuts the resistive region in an elastic manner;

a mount, having a through hole for receiving the first contact member so that the first end of the first contact member passes through the through hole to be in contact with the resistive region;

a rotating member engaging with the mount; and a second contact member, disposed between the mount and the rotating member, abutting the second end of the first contact member in a movable manner.

2. The variable resistance device as claimed in claim 1, wherein the mount has an another through hole, whereby the rotating member passes through the another through hole to engage with the mount.

3. The variable resistance device as claimed in claim 2, wherein the first contact member comprises;

a rivet abutting the resistive region;

a spring, disposed inside the through hole for receiving the first contact member, surrounding the rivet and abutting the rivet in one end; and a ball abutting the second contact member and the other end of the spring.

4. The variable resistance device as claimed in claim 2, wherein the first contact member comprises:

a spring disposed inside the through hole for receiving the first contact member;

a first ball disposed between the second contact member and one end of the spring; and a second ball disposed between the substrate and the other end of the spring.

5. The variable resistance device as claimed in claim 2, wherein the first contact member comprises:

a rivet abutting the resistive region; and a spring, surrounding the rivet, disposed inside the through hole for receiving the first contact member.

6. The variable resistance device as claimed in claim 3, wherein the second contact member has a hollow portion for the rotating member passing through.

7. The variable resistance device as claimed in claim 6, further comprising a housing, wherein the housing has a first portion for combining with the substrate and a second portion for combining with the rotor.

8. A variable resistance device, comprising:

a substrate with a resistive region forming thereupon; and a rotor rotatably disposed on the substrate, the rotor having:

a first contact member having a first end and a second end, wherein the first end abuts the resistive region;

a mount, having a through hole for receiving the first contact member so that the first end of the first contact member passes through the through hole to be in contact with the resistive region;

a rolating member engaging with the mount;

a second contact member, disposed between the mount and the rotating member, abutting the second end of the first contact member in a movable manner; and a cushion member, disposed between the second contact member and the rotating member, for cushioning the contact between the first contact member and the resistive region.

9. The variable resistance device as claimed in claim 8, wherein the mount has an another through hole, whereby the rotating member passes through the another through hole to engage the mount.

10. The variable resistance device as claimed in claim 9, wherein the first contact member comprises:

a rivet abutting the resistive region;

a spring, disposed inside the through hole for receiving the first contact member, surrounding the rivet and abutting the rivet in one end; and a ball abutting the second contact member and the other end of the spring.

11. The variable resistance device as claimed in claim 9, wherein the first contact member comprises:

a spring disposed inside the through hole for receiving the first contact member;

a first ball disposed between the second contact member and one end of the spring; and a second ball disposed between the substrate and the other end of the spring.

12. The variable resistance device as claimed in claim 9, wherein the first contact member comprises:

a rivet abutting the resistive region; and a spring, surrounding the rivet, disposed inside the through hole for receiving the first contact member.

13. The variable resistance device as claimed in claim 10, wherein the second contact member has a hollow portion for the rotating member passing through.

14. The variable resistance device as claimed in claim 13, further comprising a housing, wherein the housing has a first portion for combining with the substrate and a second portion for combining with the rotor.

15. A variable resistance device, comprising:

a substrate with a resistive region forming thereupon; and a rotor rotatably disposed on the substrate, the rotor having:

a first contact member having a first end and a second end, wherein the first end abuts the resistive region in an elastic manner;

a mount having a first through hole and a receiving portion for receiving the first contact member, wherein a rotating member passes through the first through hole to engage with the mount; and a conducting interface formed on a surface, abutting the mount, of the rotating member, wherein the conducting interface abuts the second end of the first contact member in moveable manner.

16. A variable resistance device, comprising:

a substrate with a resistive region forming thereupon; and a rotor rotatably disposed on the substrate, the rotor having:

a first contact member having a first end and a second end, wherein the first end abuts the resistive region in an elastic manner;

a mount having a through hole for receiving the first contact member so that the first end of the first contact member passes through the through hole to be in contact with the resistive region;

a rotating member engaging with the mount; and a conducting interface formed on a surface, abutting the mount, of the rotating member, wherein the conducting interface abuts the second end of the first contact member in a moveable manner.

17. The variable resistance device a claimed in claim 16, wherein the first contact member comprises:

a rivet abutting the resistive region;

a spring, disposed inside the through hole, surrounding the rivet and abutting the rivet in one end; and a ball abutting the conducting interface and the other end of the spring.

18. The variable resistance device as claimed in claim 16, wherein the first contact member comprises:

a spring disposed inside the through hole;

a first ball disposed between the conducting interface and one end of the spring; and a second ball disposed between the substrate and the other end of the spring.

19. The variable resistance device as claimed in claim 16, wherein the first contact member comprises:

a rivet abutting the resistive region;

a spring surrounding the rivet, disposed inside the through hole.

20. The variable resistance device as claimed in claim 17, further comprising a housing, wherein the housing has a first portion for combining with the substrate and a second portion for combining with the rotor.

* * * * *